United States Patent [19]

De Santis

[11] Patent Number: 4,991,525

[45] Date of Patent: Feb. 12, 1991

[54] DRIVING MECHANISM FOR THE UPPER LOOPER IN OVERLOCK SEWING MACHINES

[75] Inventor: Gennaro De Santis, Pavia, Italy

[73] Assignee: Rimoldi S.R.L., Milan, Italy

[21] Appl. No.: 397,724

[22] Filed: Aug. 23, 1989

[30] Foreign Application Priority Data

May 31, 1989 [IT] Italy ..... 20712 A/89

[51] Int. Cl.[5] ..... D05B 57/14

[52] U.S. Cl. ..... 112/199; 112/200

[58] Field of Search ..... 112/162, 166, 199, 200

[56] References Cited

U.S. PATENT DOCUMENTS

| | | | |
|---|---|---|---|
| 1,213,424 | 1/1917 | Seymour | 112/200 |
| 1,419,997 | 6/1922 | Valois | 112/200 X |
| 3,871,311 | 3/1975 | Ciecior et al. | 112/200 |

*Primary Examiner*—Werner H. Schroeder
*Assistant Examiner*—Paul C. Lewis
*Attorney, Agent, or Firm*—Hoffmann & Baron

[57] ABSTRACT

The driving mechanism comprises a driving arm (10) fastened to a drive shaft (9) operated with an oscillatory movement about its own axis. Pivoted to the free end of the driving arm (10) is a support arm (11) carrying an upper looper (4). The support arm is also fastened to an auxiliary arm (12) pivotally mounted to a bearing pin (13). The bearing pin is eccentrically fixed to an auxiliary pivot pin (15) housed in the machine bed (2), with possibility of rotation about an axis which is offset relative to the axis of the support pin. The auxiliary pin (15) can be selectively oriented about its own axis according to different angular positions for the purpose of modifying the position of the axis of the bearing pin (13) and, as a result, the path taken by the upper looper (4).

3 Claims, 2 Drawing Sheets

1
2
3
4
4a
5
5a
6
7
7a
8
8a
9
10
11
11a
11b
12
12a
13
14
15
16
F
F'

DRIVING MECHANISM FOR THE UPPER LOOPER IN OVERLOCK SEWING MACHINES

BACKGROUND OF THE INVENTION

1. Field of the Invention

The present invention relates to a driving mechanism for the upper looper in overlock sewing machines, of the type comprising: a drive shaft rotatably mounted to the bed of a sewing machine and operated with an angular oscillatory movement about its own axis; a driving arm fastened to the drive shaft and extending therefrom in a substantially radial direction; a support arm pivoted to the driving arm at the lower part thereof and fixedly supporting said upper looper; a bearing pin connected to the machine bed and disposed sideways of the support arm, on the opposite side relative to the drive shaft; an auxiliary arm rotatably connected to the bearing pin, extending from said pin in a substantially radial direction and having its free end pivotally mounted to the support arm.

2. Description of the Related Art

It is known that in overlock sewing machines the upper looper performs a reciprocating motion following a path which extends on either side of the edges of the needle plate and the workpiece. At the bottom dead center of its stroke the upper looper engages the thread carried by the lower looper and then jumps over the needle plate and workpiece. In this manner the thread carried by the upper looper is arranged so that it is engaged by the needle or needles above the workpiece itself.

From the foregoing it appears that the upper looper must take a very precise path, dictated by various parameters among which it is particularly important the thickness of the workpiece, the width that the line of stitching must have and the number of needles provided for carrying out the stitching.

Presently the displacements of the upper looper according to the desired path can take place by means of various driving mechanisms.

According to one known driving mechanism the upper looper must be fastened to a support arm the lower end of which is pivotally mounted to a driving arm which, through a shaft rotating about its own axis, receives an oscillatory movement in a substantially vertical direction. The support arm is also fastened, close to its upper end, to an auxiliary arm extending in an opposite direction relative to the driving arm, from a respective bearing pin mounted to the sewing machine bed. Due to the connection created by the auxiliary arm, when the driving arm causes the support arm and the looper to rise, the upper part of the support arm and therefore the looper tip is made to rotate about the axis of the bearing pin.

The combination of movements transmitted by the driving arm and the auxiliary arm respectively, causes the looper tip to move according to a path of the type shown at A in FIG. 1. Also diagrammatically shown in said figure is the needle plate of the machine, seen in cross-section and identified by 5 and the path taken by the needle, identified by *7a*, as well as that taken by the lower looper and identified by *8a*.

Although the above described deriving mechanism has proved to be capable of performing the functions it has been designed for, it has however an important drawback in that it does not allow the looper path to be altered when the sewing machine must be used with a workpiece having a different thickness or when it is necessary to perform lines of stitching having a different width and/or using a different number of needles as compared to the preceding sewing. Therefore until now the sewing machines using this type of driving mechanism could only be used for carrying out a specific type of working.

In order to achieve a greater versatility of use in the field of these sewing machines a driving mechanism has been designed in which the support arm of the upper looper is slidably engaged through a cylindrical element which in turn is accommodated, rotatably about a horizontal axis, within an eccentric sleeve supported by the machine bed. The support arm is engaged in such a manner that, together with the vertical displacements transmitted by the driving arm, it undergoes a rotation according to the axis of the cylindrical element, so as to guide the upper looper according to a path identified by B in FIG. 1. This path can be altered by modifying the angular orientation of the eccentric sleeve about its own axis. In fact, by rotating the eccentric sleeve, it is possible to achieve a displacement in the axis of rotation of the cylindrical element through which the support arm is guided.

It will be understood, however, that when the eccentric sleeve is acted upon in order to modify the path of the upper looper it is also necessary to carry out further long operations in order to retime the lower looper and the needle or needles relative to the upper looper. This is substantially due to the fact that when the path is modified it undergoes great displacements at its bottom dead center where the upper looper must slightly touch the lower looper in order to engage the thread of said lower looper.

In addition it has been found that the slidable engagement of the support arm in the cylindrical element often gives rise to problems concerning lubrication, wear and noise.

Driving mechanisms have been also accomplished in which the cylindrical element engaging the support arm of the looper is rotatably housed within a block in turn fastened to the machine bed by means of threaded elements operating through respective elongated holes horizontally formed in said block. By unloosing said threaded elements it is possible to horizontally shift the block and, consequently, the axis of rotation of the cylindrical element. In addition, said elongated holes are disposed in such a manner that the shifting of said axis of rotation is also possible in a vertical direction, if said block is dismantled and then mounted again in a 180° overturned condition.

Due to this solution, in which the looper takes the path identified by "C" in FIG. 1, it is possible to further increase the versatility of use of the sewing machine.

On the other hand, however the adjustment of the looper path is rather difficult and unpractical.

In addition, this driving mechanism has all drawbacks described above with reference to the driving mechanism using the eccentric sleeve, as the movement of the upper looper substantially takes place in the same manner.

SUMMARY OF THE INVENTION

In the light of the above drawbacks, the main object of the present invention is substantially to solve the problems of the known art, by providing a driving mechanism which is capable of suitably modifying the path of the upper looper without involving long operations for restoring the timing of the upper looper with respect to the lower looper and the needle or needles.

The foregoing and further objects which will become more apparent in the course of the present description are substantially attained by a driving mechanism for the upper looper in overlock sewing machines, further comprising an auxiliary pivot pin integral with the bearing pin, rotatably engaged with the machine bed and extending according to an axis parallelly offset relative to the axis of the bearing pin, said auxiliary pin being selectively oriented according to different angular positions about its own axis in order to modify the position of the axis of the bearing pin.

BRIEF DESCRIPTION OF THE DRAWINGS

Further features and advantages will best be understood from the detailed description of a preferred embodiment of the invention given hereinafter by way of non-limiting example with reference to the accompanying drawings, in which.

DESCRIPTION OF THE PREFERRED EMBODIMENT

Figure 2:
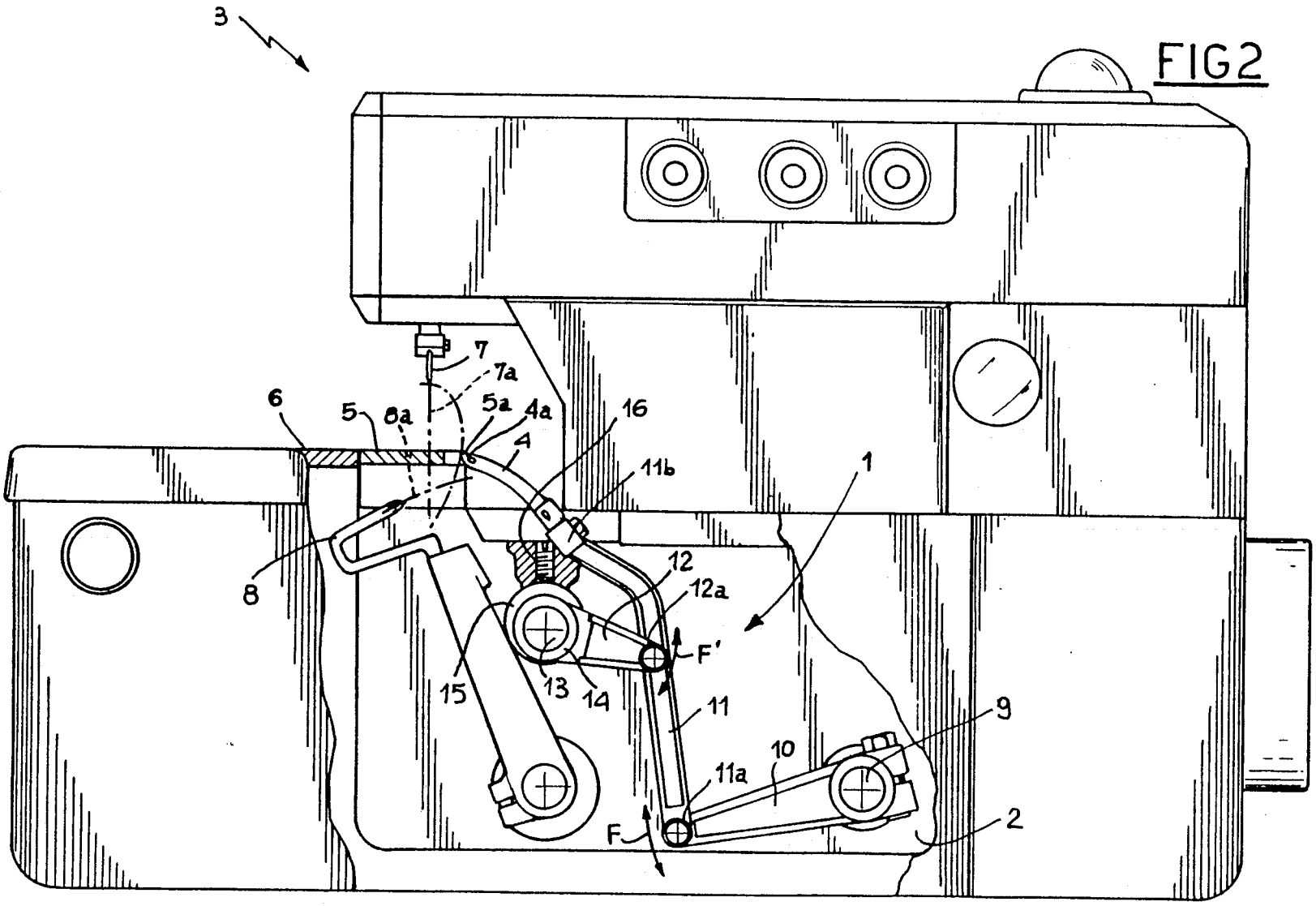
FIG. 2 is a diagrammatic front view of the driving mechanism of the invention, mounted to the bed of a sewing machine.

Referring particularly to FIG. 2, a driving mechanism for the upper looper in overlock sewing machines in accordance with the invention has been generally identified by reference numeral 1. Mechanism 1 is mounted to the inner face of a bed 2 being part of an overlock sewing machine 3 known per se and conventional. The driving mechanism 1 is adapted to reciprocate an upper looper 4 on either side of an edge 5*a* of a needle plate 5 disposed in coplanar relation with a worktable 6 along which the workpiece is infed.

In known manner, the upper looper 4 which can be provided or not with a respective thread, cooperates, for the purpose of carrying out the stitching, with at least a needle 7 provided with a rectilinear reciprocating movement through the needle plate 5 according to a path 7*a*, as well as with a lower looper 8 carrying out a reciprocating transverse movement relative to the feed direction of the workpiece, according to a path 8*a*.

In greater detail, when the upper looper 4 during its reciprocating movement is at its bottom dead center, it must engage a thread carried by the lower looper 8. When said upper looper 4 is, instead, at the top dead center of its stroke, it must be positioned above the workpiece so that the thread it carries can be engaged by the needle 7 which is descending towards the needle plate 5.

To this end, the driving mechanism comprises a drive shaft 9 rotatably engaged through the bed 2 and provided with an angular oscillatory movement about its own axis, in a manner known per se and therefore not shown. Fastened to the drive shaft 9 is a driving arm 10 extending in a substantially radial direction to the drive shaft and rotatably engaging one lower end 11*a* of a support arm 11 to the upper end 11*b* of which the upper looper 4 is fastened.

The support arm 11 is also fastened, at some point between its lower end 11*a* and upper end 11*b*, to one free end 12*a* of an auxiliary arm 12 extending in an opposite direction relative to the driving arm 10. The auxiliary arm 12 is rotatably engaged, on its opposite side relative to its free end 12*a*, with a bearing pin 13 connected to the machine bed 2 and disposed sideways of the support arm 11, on its side opposite that facing the drive shaft 9.

Figure 3:
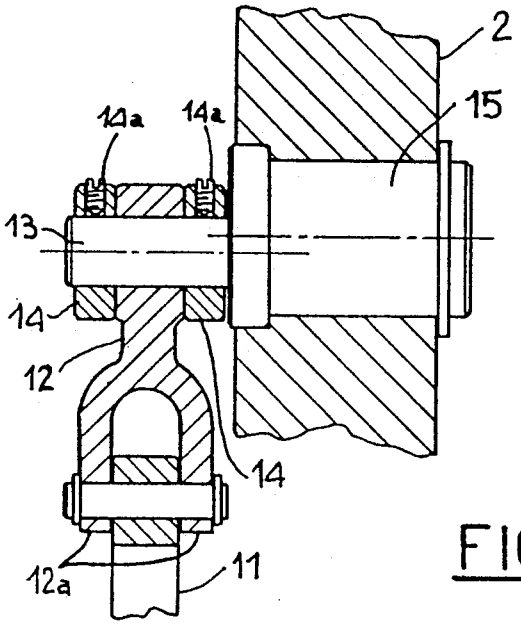
FIG. 3 is a longitudinal section of the bearing pin carrying the auxiliary arm provided in the driving mechanism of the invention.
Figure 1:
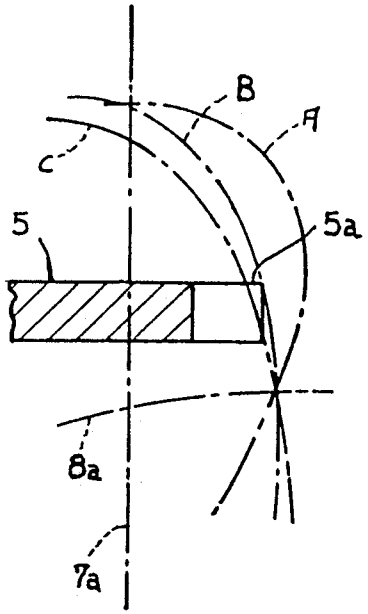
FIG1 (Prior Art)
FIG. 1 diagrammatically shows the paths of the upper looper when the driving mechanisms of the known art are used.

Preferably, as shown in FIG. 3, the auxiliary arm 12 is substantially in the form of a fork, so that it engages the support arm 11 at two symmetrically opposed parts and is made fast, as regards its axial positioning along the bearing pin 13, by means of two abutting collars 14 fastened to said pin by two threaded set pieces or the like.

In an original manner, according to the present invention, the bearing pin 13 is integral with an auxiliary pivot pin 15 extending according to a parallel and slightly offset axis relative to the axis of the bearing pin. Advantageously, the auxiliary pin 15 can be selectively oriented about its own axis according to different angular positions in order to modify the position of the axis of the bearing pin 13. In greater detail, in the example shown it is possible to modify the angular positioning of the auxiliary pin 15 by directly acting on the bearing pin 13 or on one of the abutting collars 14. The auxiliary pin 15 is then locked to the desired angular position by acting on at least a threaded set piece 16 operatively engaged across the bed 2.

Figure 4:
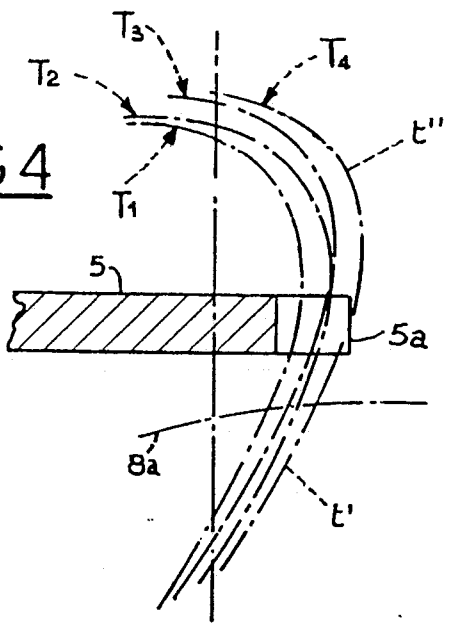
FIG. 4 diagrammatically shows four examples of paths that the upper looper can take when the device of the invention is used.

When the driving mechanism 1 is in operation, the support arm 11 and therefore the upper looper 4 carry out an oscillatory movement resulting from the vectorial sum of a substantially vertical reciprocating movement, dictated by the oscillation of the driving arm 10 according to the arrow "F" in FIG. 2, and a reciprocating rotating movement about the axis of the bearing pin 13 dictated by the engagement offered by the auxiliary arm 12 and represented by arrow "F'". Referring particularly to FIG. 4, the vectorial sum of the above specified reciprocating movements causes the tip 4*a* of the upper looper 4 to take a path $T_1$, $T_2$, $T_3$, $T_4$ which, starting from the bottom dead center of the upper looper path, exhibits a lower length t' which extends in a substantially vertical direction moving apart sideways from the path 7*a* of the needle or needles 7. This lower length t' which rises as far as it goes past the needle plate 5, is followed by an upper length t'' wherein a relatively reduced raising of the tip 4*a* brings about an important horizontal displacement of the same so that said tip comes close to and intersects the path 7*a* of the needle or needles 7. Advantageously, paths $T_1$, $T_2$, $T_3$, $T_4$ of the upper looper 4 can be modified by altering the angular orientation of the auxiliary pivot pin 15. In fact, as previously said, by rotating the auxiliary pin 15 about its own axis, after unloosing the threaded set piece 16, the displacement of the bearing pin 13 is achieved and therefore the displacement of the axis about which the auxiliary arm 12 is pivotally mounted relative to the bed 2. Consequently the center about which the reciprocating rotatory movement according to arrow F' takes place, is modified. As a result of this modification, the desired variation of path $T_1$, $T_2$, $T_3$, $T_4$ occurs.

Shown in FIG. 4, by way of example, are four possible paths which can be taken by the upper looper 4 by varying the angular positioning of pivot pin 15. In greater detail, when the auxiliary pin 15 is positioned so that the axis of the bearing pin 13, referring to FIG. 2, is spaced apart sideways to the left relative to the axis of the auxiliary pin itself, the path taken is that identified by reference $T_1$. When the axis of pin 13 is disposed exactly below the axis of the auxiliary pin 15, the path taken is that identified by reference $T_2$, $T_3$ denotes the path which is achieved when the axis of the bearing pin 13 is disposed above the axis of the auxiliary pin 15 and finally $T_4$ denotes the path which is achieved when the axis of the bearing pin 13 is located to the right of the axis of the auxiliary pin 15.

Advantageously, as can be seen by comparing paths $T_1$, $T_2$, $T_3$, $T_4$, the variation of the path taken by the upper looper 4 greatly influences the upper length t'' of the path itself, that is that part of the path in which the looper must jump over the edge of the workpiece and intersect the path *7a* of the needle or needles 7. In principle it is provided that paths $T_1$ and $T_2$ lend themselves to be used above all when lines of stitching having a reduced edge width are carried out on workpieces having a relatively reduced thickness, whereas paths $T_3$ and $T_4$ are particularly adapted when workpieces of high thickness need to be sewn and when it is necessary to execute lines of stitching with a great edge width.

Obviously, by suitably positioning the auxiliary pin 15 it is possible to accomplish an indefinite number of different paths so as to adapt the different movements of the upper looper to the execution of any type of sewing.

Still referring to FIG. 4, it will be recognized that, advantageously, the lower length t' of paths $T_1$, $T_2$, $T_3$, $T_4$ does not undergo great modifications in operation as a result of the rotation of the auxiliary pin 15. In fact the lower length t' always extends such as to intersect the path *8a* of the lower looper 8 at the dead center of the going stroke of the latter. Therefore the present driving mechanism allows the path of the upper looper 4 to be modified without involving the execution of long additional operations in order to restore the timing between the upper looper, the lower looper 8 and the needle or needles 7.

The present invention attains the intended purposes.

As clearly shown, the driving mechanism of the invention actually exhibits a great versatility in use which can be achieved while simultaneously solving the problem of the known art relating to the necessity of carrying out a new timing of the different members contributing to the formation of a stitching every time the movements of the upper looper must be modified. It is also to be pointed out that by adopting the bearing pin 13 eccentrically associated with the auxiliary pivot pin 15, the looper path can be adjusted in a very precise manner. Actually, a suitable choice of the amount of eccentricity of the bearing pin relative to the auxiliary pin 15 allows light displacements of the bearing pin itself to be achieved in consequence of great angular rotations of the auxiliary pin.

It is also to be noted that advantageously the present driving mechanism has no parts in mutual sliding relation but substantially consists of pivotally mounted arms. Therefore all problems of lubrication, wear and noise which can be found in known devices in which the looper support arm is liable to slide within a cylindrical element, are eliminated.

Obviously many modifications and variations can be made to the invention as conceived, all of which fall within the scope of the invention idea characterizing it.

What is claimed is:

1. A driving mechanism for use in an overlock sewing machine having an upper looper and a bed, comprising:

a drive shaft rotatably mounted to the bed of the sewing machine and operated with an angular oscillatory movement about is own axis;

a driving arm fastened to the drive shaft and extending therefrom in a substantially radial direction, the driving arm having a lower part;

a support arm pivoted to the driving arm at the lower part thereof and fixedly supporting said upper looper;

a bearing pin having an axis along which the bearing pin extends, the bearing pin being connected to the bed of the sewing machine and disposed sideways of the support arm and opposite to the drive shaft;

an auxiliary arm rotatably connected to the bearing pin, extending from said pin in a substantially radial direction and having its free end pivotally mounted to the support arm, wherein said mechanism further comprises an auxiliary pivot pin integral with the bearing pin, rotatably engaged with the bed of the sewing machine and extending according to an axis parallelly offset relative to the axis of the bearing pin, said auxiliary pin being selectively oriented according to different angular positions about its own axis in order to modify the position of the axis of the bearing pin.

2. The driving mechanism as claimed in claim 1, further comprising at least a threaded set piece operatively engaged in the machine bed and acting upon the auxiliary pivot pin in order to fix its angular positioning.

3. The driving mechanism as claimed in claim 1, wherein said auxiliary arm is substantially fork shaped and engages the support arm at two symmetrically opposed locations.

* * * * *